United States Patent [19]

Wingate

[11] Patent Number: 4,506,800

[45] Date of Patent: Mar. 26, 1985

[54] MACHINE FOR VENDING ARTICLES SUCH AS NEWSPAPERS, MAGAZINES AND THE LIKE

[75] Inventor: W. Jack Wingate, Charlotte, N.C.

[73] Assignee: Hennessy Products, Incorporated, Chambersburg, Pa.

[21] Appl. No.: 496,089

[22] Filed: May 19, 1983

[51] Int. Cl.[3] ..... G07F 11/28

[52] U.S. Cl. ..... 221/6; 221/9; 221/17; 221/65; 221/194; 221/289

[58] Field of Search ..... 221/6, 9, 14, 17–18, 221/65, 155, 191, 193–195, 289, 295

[56] References Cited

U.S. PATENT DOCUMENTS

| | | | |
|---|---|---|---|
| 388,369 | 8/1888 | Morse et al. | 221/289 X |
| 4,312,461 | 1/1982 | Godcey, Sr. | 221/195 |
| 4,365,701 | 12/1982 | Armstrong et al. | 221/289 X |

FOREIGN PATENT DOCUMENTS

| | | | |
|---|---|---|---|
| 2101573 | 1/1983 | United Kingdom | 221/194 |

*Primary Examiner*—Charles A. Marmor
*Attorney, Agent, or Firm*—F. Travers Burgess

[57] ABSTRACT

A machine for vending flat articles, such as newspapers, magazines and the like comprises an enclosed cabinet having a merchandise storage magazine with an inclined bottom wall and an inclined outlet chute substantially aligned with the magazine bottom wall and having a discharge opening communicating with the exterior of the cabinet, a series of connected vertically movable telescoping members forming a bar between the storage magazine and the outlet chute, endless chains extending vertically at both sides of the storage magazine and mounted at their opposite ends on sprockets mounted on shafts journaled in the magazine side walls, the uppermost of said telescoping members being connected at its sides to the respective chains, motor drivingly connected to one of said shafts for lowering the uppermost telescoping member to release individual articles from the storage magazine and permit them to slide over the uppermost telescoping member and onto the outlet chute, coin-actuated command module for energizing the motor and a switch responsive to movement of a released article across the top of the uppermost telescoping member for de-energizing the motor and interrupting downward movement of the bar after each article has passed from the magazine onto the outlet chute.

14 Claims, 10 Drawing Figures

MACHINE FOR VENDING ARTICLES SUCH AS NEWSPAPERS, MAGAZINES AND THE LIKE

BACKGROUND OF THE INVENTION

1. Field of the Invention

The invention relates to coin-controlled merchandise dispensing apparatus and consists particularly in a coin-operated mechanism for vending flat articles such as newspapers, magazines and the like.

2. Related Applications

Application of W. Jack Wingate, Ser. No. 343,157 entitled Machine for Vending Articles Such as Newspapers, Magazines and the Like was filed Jan. 27, 1982.

3. The Prior Art

Prior attempts to provide a coin operated newspaper vending machine arranged to dispense a single newspaper upon insertion of the proper coinage have included G. D. Morse et al U.S. Pat. No. 388,369, H. O. Moore U.S. Pat. Nos. 3,907,160 and 4,139,120 and F. O. Godley, Sr. U.S. Pat. No. 4,312,641. The Morse patent, Moore U.S. Pat. No. 4,139,120 and the Godley, Sr. patent each has a single article receiving magazine with a sloping bottom wall. In the Morse patent, the newspapers are retained and individually released from the magazine by an upright vertically movable bar or post, necessitating that the bottom wall of the magazine be a distance above the bottom of the machine cabinet at least equal to the height of the movable bar. In Moore U.S. Pat. No. 4,139,120 a vertically movable carriage is mounted adjacent the front of the stack of newspapers in the magazine and has holddown arms which overlie the newspapers and an article engaging element for moving the topmost paper upwardly and rearwardly clear of the holddown arms to permit release of the paper, the papers below the carriage being retained by a chain windable about drums mounted on the carriage, the carriage being lowered gravitationally responsive to the holdback apparatus sensing the removal of the top paper from the stack. In the Godly patent, the inclined floor of the magazine is vertically removable relative to a stationary retainer post, movement being imparted by the purchaser through a crank driven screw device. In Moore U.S. Pat. No. 3,907,160 the individual newspapers are mounted in individual compartments in the magazine, each having a sloping bottom wall to effect gravitational delivery of the papers and a vertically slidably movable carriage is positioned in front of the magazine and is released for gravitational descent responsive to the insertion of proper coinage; for retaining newpapers in the magazine below the carriage until the carriage has descended to their level, a chain secured to the bottom of the magazine extends upwardly therefrom and over a drum on the carriage where it is connected to a cable, the other end of which is secured to a spring driven reel so as to maintain the chain taut irrespective of the height of the carriage.

SUMMARY OF THE INVENTION

The invention provides a machine in which single copies of newspapers or similar articles may be dispensed individually upon insertion of the proper coinage without any action on the part of the purchaser other than insertion of the coins, in which nearly the full height of the cabinet can be utilized for stacking newspapers, which cannot be done in a machine having a fixed length dispensing bar or post, but without utilizing a flexible member, such as a chain, as part of the newpaper retaining mechanism, with consequent possibility of the same becoming kinked and thus interfering with dispensing of the articles in the machine.

This objective is achievd by providing a series of vertically elongated telescoping members secured to vertically guided cross members below the dispensing head which is arranged to move vertically responsive to insertion of proper coinage for release of individual newspapers from the stack, movement of the dispensing head downwardly being effected by an electric motor or equivalent motive power started by insertion of proper coinage and stopped by means responsive to movement of the top paper in the stack over the dispensing head.

The machine also includes a display window displaying a copy of the current paper with which the machine is stocked and arranged to discharge this copy upon insertion of proper coinage after the last paper has been discharged from the magazine, the display window chamber being provided with a lengend visible from the front of the machine indicative that the machine is empty.

DETAILED DESCRIPTION OF THE INVENTION

Figure 3:
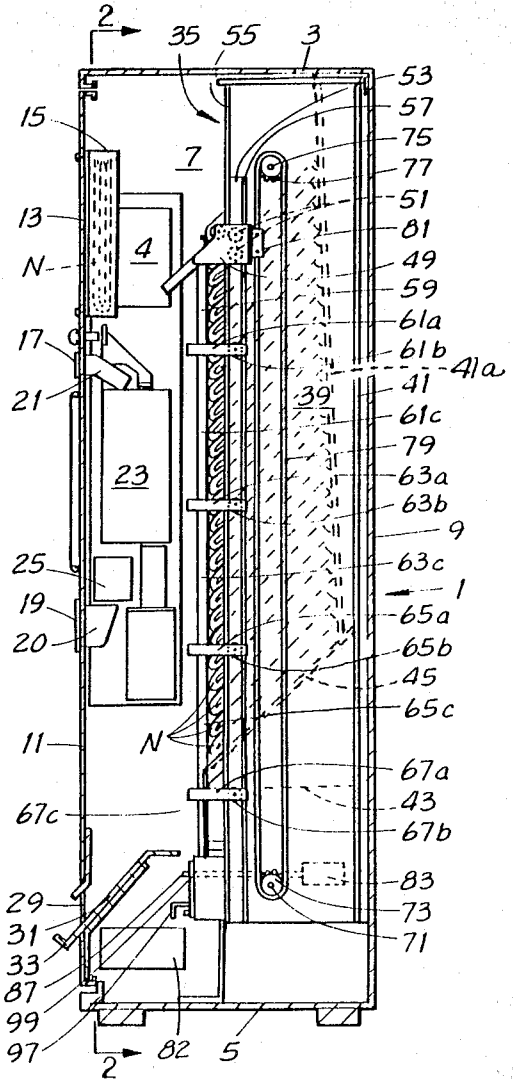
FIG. 3 is a vertical sectional view taken along line 3—3 of FIG. 2.

The numeral 1 generally indicates a cabinet having a top wall 3, a bottom wall 5, a left side wall 7 and a right side wall 8, a rear wall 9 and a front wall 11 connected by a piano hinge 14 to the front vertical margin of left-hand side wall 7 to be swung from a closed operating position to an open position for insertion of newspapers, removal of coins and adjustment and maintenance of the mechanism.

Front wall 11 has a rectangular display window 13 in its upper portion behind which is a shallow upwardly open chamber 15 for the insertion of a display newspaper indicative of the availability of newspapers in the machine. Near the left margin of the door 11 and slightly below display window 13 is a coin slot 17 directly below which is a coin return pocket 19. Coin slot 17 has a chute 21 inside the door which communicates with a coin channel assembly 23 mounted on left side wall 7 of cabinet 1 immediately below coin chute 21 and inwardly of front wall 11. Below coin channel assembly 23 coin return hopper 25 leads to coin return pocket 20. Coin channel assembly 23 is operatively connected to command module 27 mounted above it on left side wall 7.

Front wall 11 is also provided with a transverse elongated delivery aperture 29 through which sloping newspaper delivery chute 31 projects and terminates in an upturned lip 33 at its outer end to prevent discharge newspapers from dropping to the ground.

Within cabinet 1 is positioned a storage magazine generally indicated at 35 and having a left side wall 37, a right side wall 39, a rear wall 41 and a bottom wall 43 on which is supported a sloping chute 45 on which newspapers N and the like are supported for delivery by gravity upon insertion of the proper coin or combination of coins into slot 17. The inclination of chute 45 is at least equal to the angle of slide of newspapers on newspapers and an inner rear wall 41*a* intersects chute 45 substantially the same distance from the front of the magazine as the rear edge of a folded newspaper resting on the chute, and slopes slightly forwardly from its juncture with chute 45 to compensate for the accumulated thickness of the folded forward edge of newspapers stored in the magazine and thus maintain the upper surface of each newspaper at substantially the same inclination as chute 45. Magazine chute 45 is at a slightly higher level than delivery chute 31 so that the last newspaper in magazine chute 45 will, when freed to do so, drop by gravity into and through delivery chute 31.

For maintaining newspapers N in flat condition in the magazine, a paperweight rod 46 inclined parallel to sloping chute 45 is mounted by means of a T-shaped fitting 46*a* slidably received in a central vertical slot 50 in magazine rear wall 41*a* so as to move downwardly by gravity as the newspapers are dispensed.

For retaining newspapers N in the magazine and selectively discharging them responsive to insertion of proper coins in coin slot 17, an upright dispensing device consisting of a dispensing head 47 mounted on carriage 48 extending across the open front of the magazine and having rearwardly extending ears 49 at its ends on which are journaled vertically and transversely spaced rollers 51, two of which at each side ride in channels 53 formed by the outturned flanges 55 on magazine side walls 37 and 39 and angles 57 secured to the outer surface of the respective side walls rearwardly of front flanges 55, such that the dispenser head is movable vertically along the open front of the magazine but is not capable of tilting. For retaining all newspapers below the dispenser head in the magazine, the dispenser head has a pair of depending slotted legs 59 spaced apart transversely of head 47 and symmetrically disposed with respect to the sides of the head and a series of vertically spaced horizontal cross bars 61, 63, 65 and 67, positioned below dispensing head 47, are each provided with rearwardly extending ends 61*a*, 63*a*, 65*a* and 67*a*, each having a roller 61*b*, 63*b*, 65*b* and 67*b* riding in channel 53. Each cross bar 61, 63, 65 and 67 is provided with a pair of vertical slotted legs 61*c*, 63*c*, 65*c* and 67*c*, each pair of which is spaced slightly further apart transversely of the magazine than the pair associated with the cross bar above it and pins 60 pass through the slots of adjacent pairs of slotted legs 59 and 61*c*, 61*c* and 63*c*, 63*c* and 65*c*, and 65*c* and 67*c*, the lowermost of which, legs 67*c*, are vertically slidably received in pockets 69 secured to the front of the magazine structure.

Figure 2:
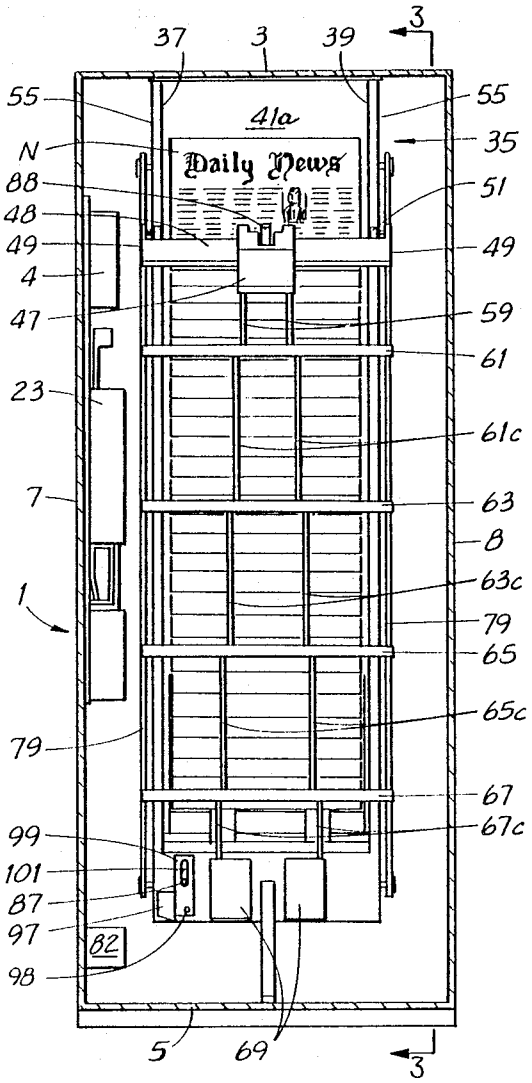
FIG. 2 is a transverse vertical sectional view from the front taken along line 2—2 of FIG. 3 showing the dispensing mechanism in filled condition.
Figure 1:
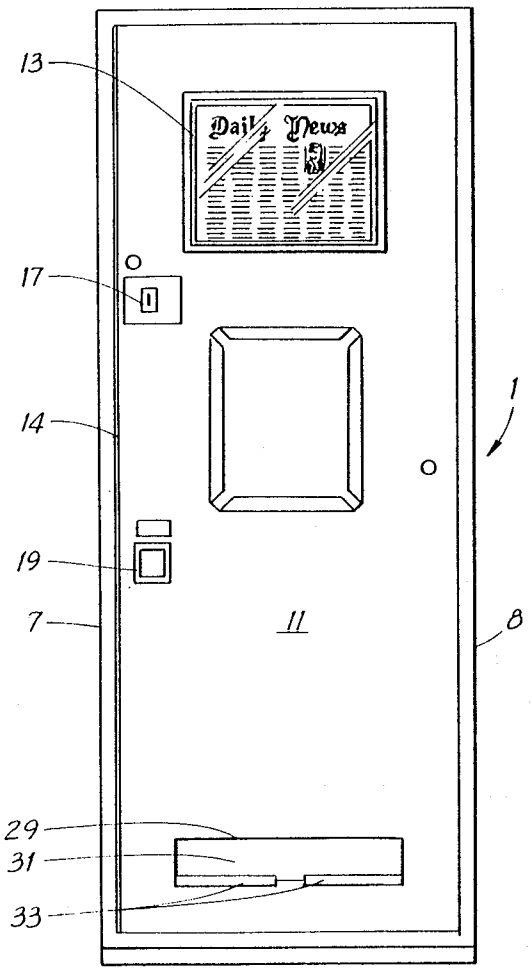
FIG. 1 is a front elevation of a vending machine constructed in accordance with the invention.
Figure 5:
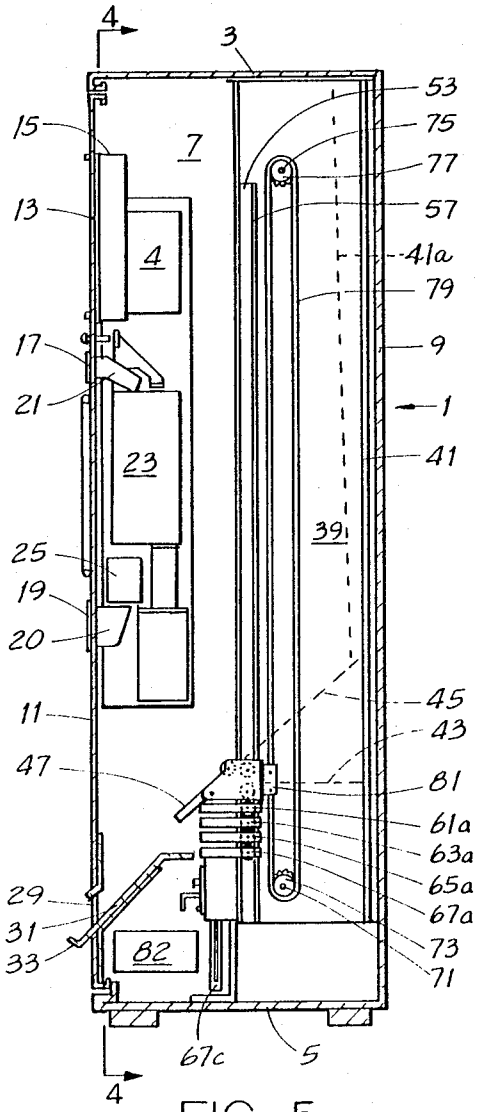
FIG. 5 is a vertical sectional view taken along line 5—5 of FIG. 4 and corresponding to FIG. 3, but showing the dispensing mechanism in empty condition.
Figure 4:
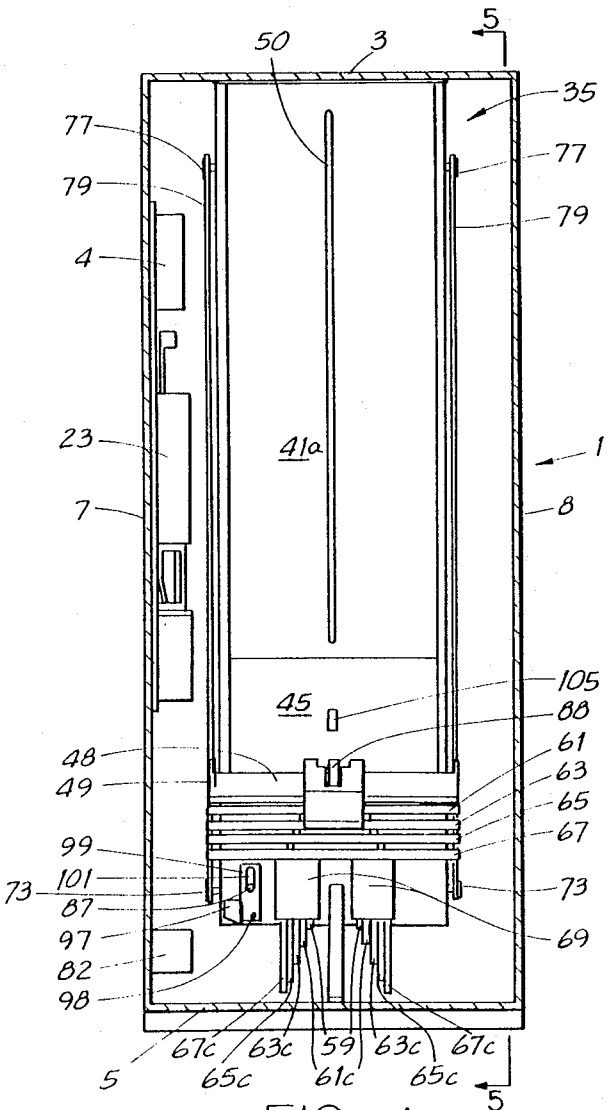
FIG. 4 is a transverse vertical sectional view corresponding to FIG. 2, but showing the dispensing mechanism in empty condition.
Figure 6:
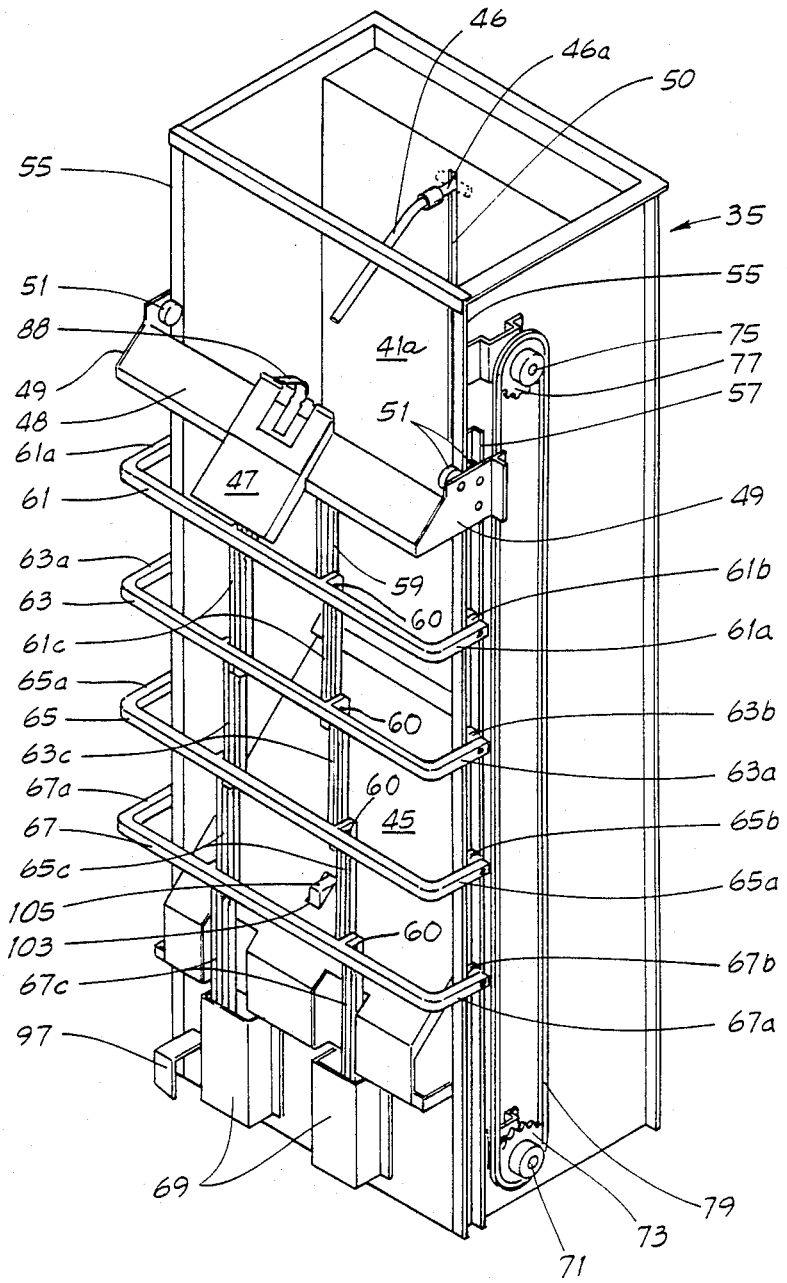
FIG. 6 is an isometric view of the magazine and dispenser assembly.
Figure 8:
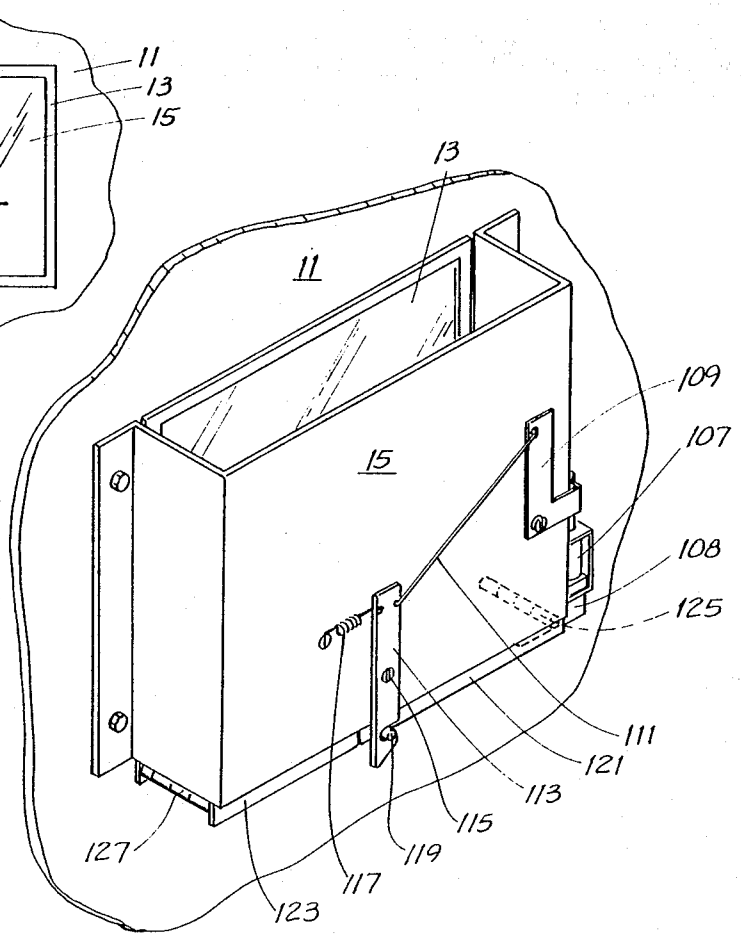
FIG. 8 is an isometric view of the display chamber.
Figure 9:
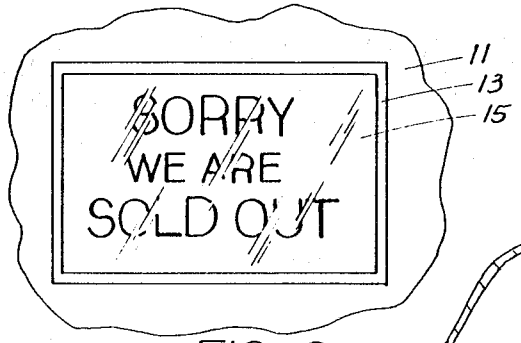
FIG. 9 is a fragmentary view of the cabinet door, showing the display window in empty condition.

From the foregoing it will be evident that dispensing head 47 is vertically movable relative to the sloping bottom wall 45 of the magazine from a point in which it is abreast of the forward edge of the top newspaper N as seen in FIGS. 2 and 3 when the magazine is fully loaded to a bottom position accommodated by the telescoping relationship of the dispensing head and the cross bar assemblies 61, 63, 65, 67 in which the top of the dispensing head 47 is flush with the sloping bottom wall 45 of the magazine, as seen in FIGS. 4 and 5.

For positioning the dispensing head 47 at different locations during its vertical travel to release individual newspapers selectively in accordance with the insertion of proper coinage, a drive shaft 71 is journaled at its opposite ends in side walls 37 and 39 of the magazine and mounts on its projecting ends drive sprockets 73 and near the top of the magazine side walls trunnions 75 project outwardly and idler sprockets 77 are journaled on trunnions 75 and endless chains 79 are supported on and mesh with drive sprockets 73 and idler sprockets 77 and ears 49 on dispensing head 47 are formed with rearwardly extending flanges 81 secured to links of chains 79. With this arrangement, as drive shaft 71 is rotated in a counterclockwise direction when viewed from the right side of the magazine, dispensing head 47 is lowered to permit the release of the individual newspapers retained behind it in the magazine.

Figure 7:
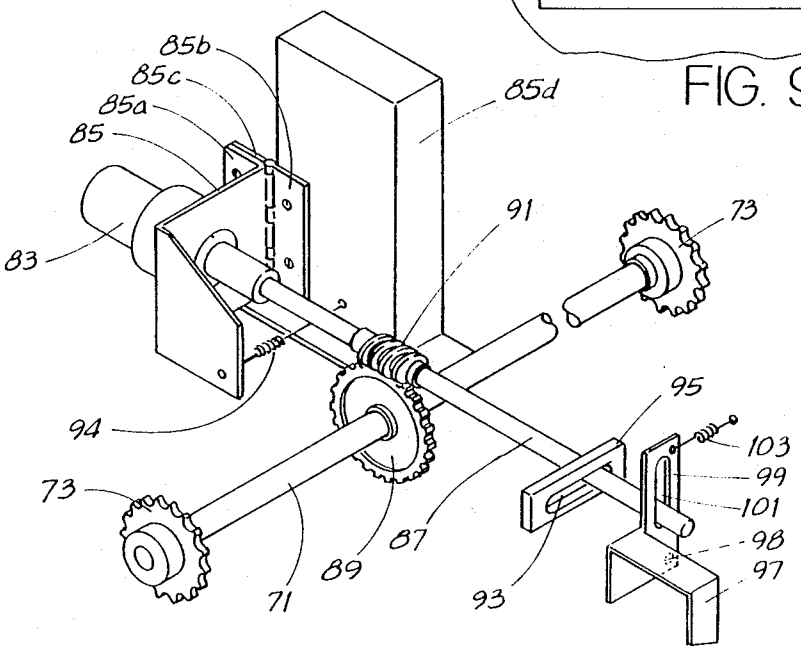
FIG. 7 is an isometric view of the dispensing drive subassembly.

For driving shaft 71, as best seen in FIG. 7, an electric motor 83 is supported on a bracket 85 which is secured by flange 85*a* to leaf 85*b* of a vertical hinge, the other leaf 85*c* of which is secured to an upstanding support member 85*d* mounted on the bottom of the magazine. Its output shaft 87 is at right angles to sprocket drive shaft 71 and slightly above drive shaft 71, to which it is drivingly connected by a worm gear comprising a gear 89 on sprocket shaft 71 and a worm 91 on motor shaft 87 which normally meshes with gear 89 so that when motor 83 is energized by command module 27 responsive to the insertion of proper coinage through coin slot 17, worm 91 will drive gear 89, rotating sprocket drive shaft 71 and drive sprockets 73 a sufficient distance counterclockwise to lower dispensing head 47 the thickness of the forward edge of the top newspaper, permitting the same to slide over the dispensing head 47 and through the outlet chute where it can be picked up by the purchaser. Energy to operate motor 83 is provided by an electric power source exemplified by battery 80 mounted in a suitable box 82 on side wall 7 of the cabinet and connected by a conductor 84 to a normally open switch 86 in command module 23 closable by the insertion of the proper coins in coin slot 17. For deenergizing the motor as soon as a newspaper is released and thereby stopping the dispensing head in front of the next newspaper on the stack, dispensing head 47 is formed with a slot near its upper edge in which is positioned an upwardly biased switch actuator 88 controlling a normally closed switch 90 in the motor circuit in series with the command module 27, so that as soon as the released newspaper slides onto the dispensing head, switch 90 opens, breaking the motor circuit. As soon as the newspaper passes switch actuator 88, switch 90 automatically returns to its closed position for the next cycle. It will be understood that this cycle will be repeated each time the proper coinage is inserted until the dispensing head moves to its lowest position co-planar with the sloping bottom wall 45 of the magazine, and the bottom newspaper is dispensed.

Magazine chute 45 is formed with a central aperture 103 containing an upwardly biased pressure responsive double-through switch 105 which is held down by any newspapers in the magazine to form an electrical connection via normally closed delivery switch 88 between the coin controlled switch and motor 83, but which springs upwardly to break the circuit between the coin controlled switch 86 and motor 83 and complete a connection between coin controlled switch 86 and a solenoid 107 mounted on the side of display window chamber 15, which, when energized by the command module switch, acts through a bellcrank 109 and a tension member 111 to move latch plate 113, pivoted at 115 to the rear wall of the display window chamber 15 clockwise against spring 15, thereby releasing latch pin 119 projecting rearwardly from display window chamber drop door 121 and permitting door 121 and overlapping door 123 to drop open about their hinges 125 and 127, thereby releasing the display newspaper indicating to prospective purchasers that the machine is empty. To permit the dispensing head and retainer arms 61, 63, 65 and 67 to return to their normal operating positions, the forward end of motor shaft 87 projects forwardly through a transversely elongated slot 93 in a bearing block 95 secured to the front wall of the magazine, being biased against the right hand end of slot 93 by tension in a coil spring 94 connecting motor bracket 85 to support member 86, and a foot pedal 97 projecting horizontally forwardly from the front wall of the magazine is pivoted to the same by pin 98 on an axis perpendicular to the front wall and is formed with an upward extension 99 vertically slotted at 101 and receiving in slot 101 the projecting forward end of motor drive shaft 87 so that by depressing pedal 97 the engagement of shaft 99 with pedal slot 101 causes the motor 83, its mounting bracket 85 and shaft 87 to move to the left in bearing block slot 93, in opposition to spring 94, to disengage worm 91 from gear 89 and permit manual elevation of dispensing head 47 to its normal position, wherein its upper surface is flush with the top of the uppermost newspaper in the magazine. As soon as this movement is completed, the operator may remove his foot from pedal 97 and tension spring 103, attached at one end to pedal 97 and at its other end to the magazine, will cause pedal 97 to rotate clockwise to its normal position, returning worm 91 into operative engagement with worm gear 89.

Figure 10:
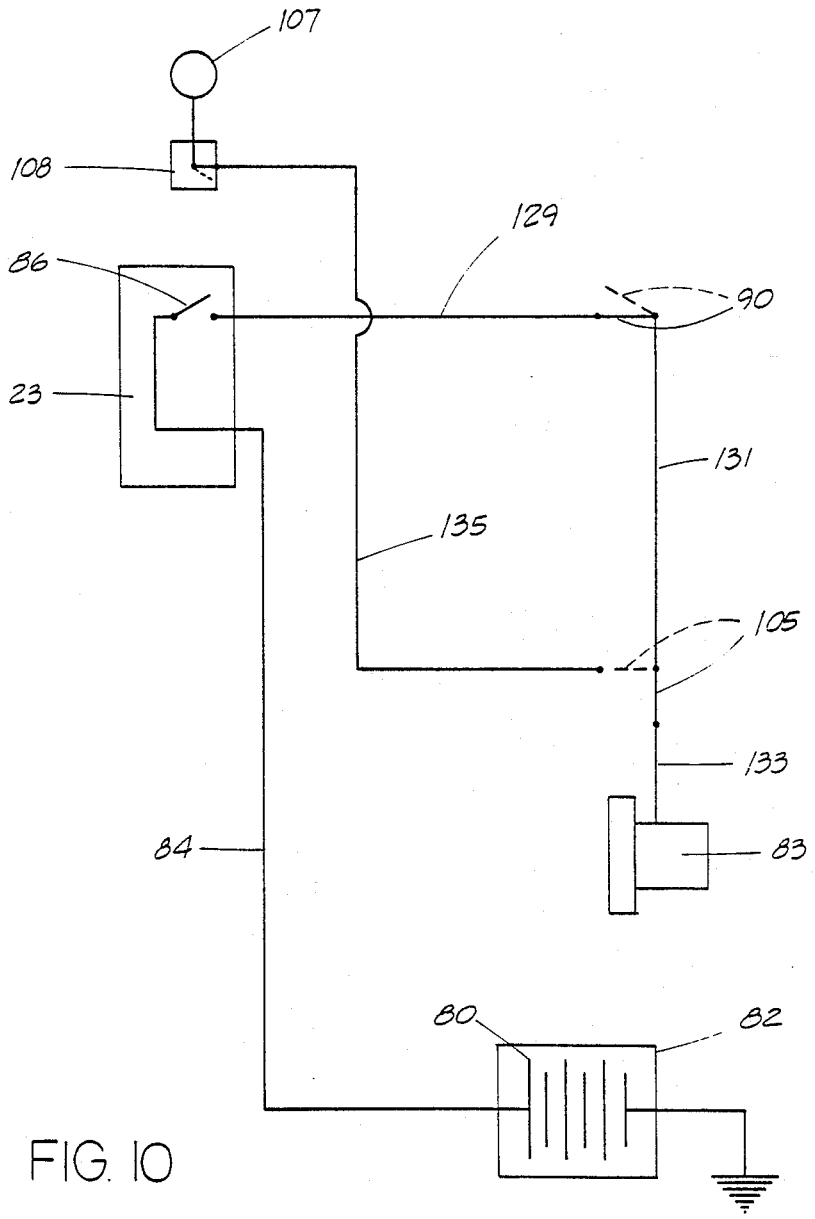
FIG. 10 is a schematic electrical circuit diagram of the apparatus.

The magazine is initially filled with newspapers until the top of the uppermost newspaper is flush with the top of dispensing head 47 so that upon insertion of the proper coinage into coin slot 17, after the coin(s) pass(es) through coin intake chute 21 and the command module 23, the coin(s) cause(s) switch 86 to close and it is connected electrically to motor 83 via conductor 129, normally open pressure responsive switch 90, conductor 131, pressure responsive double-throw switch 105 and conductor 133 (as best seen in FIG. 10) so as to energize motor 83, and thus initiate downward movement of dispensing head 47 until the circuit is broken by passage of the top newspaper over switch actuator 88 to permit switch 90 to open, thus halting downward movement of dispensing head 47 so that its upward surface is substantially flush with the top of the uppermost newspaper in the magazine and taking command module 23 back to zero, thus opening switch 86. When the last newspaper resting on the magazine bottom wall 45 passes over switch 105 which is normally in the solid line position shown in FIG. 2, the release of pressure on switch 105 causes it to throw to the broken line position shown in FIG. 10 which connects it via conductor 135 and normally closed switch 108 on display window chamber 15 with solenoid 107, such that upon insertion of a coin in slot 17 after the last newspaper has been discharged from the magazine, instead of energizing motor 83 to lower dispensing head 47 switch 105 energizes display solenoid 107, releasing spring actuated latch 113, thus permitting drop doors 1 and 123 of the display window chamber 15 to open, whereby the display newspaper drops by gravity into the delivery chute to be picked up by the purchaser when it passes through delivery opening 29. Normally closed display empty switch 108 has its actuator engaging the bottom of drop door 121 so as to open when doors 121 and 123 open to release the display newspaper from the display chamber, thus deenergizing solenoid 107 and permitting its return to its non-energized condition in which spring 117 moves latch 113 to its normal latching position so that when doors 123 and 121 are swung to their closed position latch pin 119 engaging the tapered end switch of latch plate 113 pushes the latch plate crosswise sufficiently to permit pin 119 to be latchingly engaged by latch plate 113.

Operation of the machine is as follows: The machine is stocked with newspapers by opening cabinet door 11, lifting the holddown rod 46 to the upper end of slot 50, placing the desired number of newspapers in the magazine on the sloping bottom wall 45 thereof so that the top of the top newspaper is flush with the sloping upper surface of dispensing head 47, and inserting a display paper in display window chamber 15 through its open top, after which cabinet door 11 is closed and locked. When a purchaser inserts the proper change in coin slot 17, the change drops through chute 21 and into command module 23 to close switch 86, energizing motor 83 which drives sprockets 73 to move chain 79 and with it dispensing head 47 downwardly until the top newspaper slides across dispensing head 47, depressing pressure responsive switch 90 as it passes over it and breaking the motor circuit to stop downward movement of dispensing head 47, returning control module 23 to zero and opening switch 86 therein. The rear surface of dispensing head 47 positively holds the following newspaper against release until the dispensing head is again lowered as described above, meanwhile, the previously released newspaper dropping into discharge chute 31 and through discharge opening 29 where it may be picked up by the purchaser when it stops against flange 33. This cycle is repeated until the lowermost newspaper resting directly on magazine chute 45 is released by dispensing head 47 having been lowered to the position shown in FIGS. 4 and 5 in which it is substantially co-planar with magazine chute 45. When this occurs, as the last newspaper slides over the dispensing head, permitting magazine empty switch 105 to move upwardly, the latter provides an electrical connection between the command module and display solenoid 107 via conductor 135 and normally closed switch 108, so that when the last purchaser inserts a coin into coin slot 17, display solenoid 107 is energized to release the display chamber drop doors 121 and 123, permitting the display newspaper to drop downwardly into the delivery chute for pick up by the purchaser. The release of the paper from the display window exposes a legend "SORRY we are SOLD OUT" or the equivalent, thus warning prospective purchasers against depositing coins into the empty machine. When door 121 opened to discharge the display newspaper it also opened display empty switch 108, deenergizing solenoid 107 to permit relatching of the display window drop doors upon their manual closure. The machine may then be reloaded and its dispensing cycle repeated as described above.

The details of the machine disclosed herein may be varied substantially without departing from the spirit of the invention and the exclusive use of such modifications as come within the scope of the appended claims is contemplated.

I claim:

1. A vending machine for flat articles such as newspapers comprising wall structure forming an enclosed cabinet, a storage magazine therein having vertical side walls, a rear wall and an inclined bottom wall and being open at its front, an inclined outlet chute positioned between the front of said storage magazine and the front portion of said cabinet wall structure and substantially aligned with said inclined bottom wall and having a discharge opening in the front portion of said cabinet wall structure communicating with the exterior of said cabinet, a plurality of vertically movable telescoping members forming an obstruction between the storage magazine and the outlet chute, endless vertically disposed flexible elongated elements at each side of the magazine, vertically spaced shafts journaled in the side walls of said magazine and having wheels at their outer ends mounting the upper and lower ends of said flexible elements, said flexible elements being secured to the uppermost of said telescoping members whereby upon movement of said flexible elements in one direction said uppermost telescoping member is lowered and said telescoping members telescope to release individual articles from said magazine and permit them to slide over said uppermost telescoping member onto said outlet chute, power means drivingly connected to one of said shafts, coin-actuated means for energizing said power means, said power means including means responsive to movement of a released article across said uppermost telescoping member for de-energizing said power means and interrupting downward movement of said uppermost telescoping member after each article has passed from said storage magazine onto said chute.

2. A vending machine according to claim 1 including means for selectively disengaging said power means from said flexible element drive shaft whereby to permit manual return of said telescoping members to their full height for retention of a full stock of articles in said storage magazine.

3. A vending machine according to claim 2, including an electrical circuit having a power source, said power means comprising an electric motor in said circuit, said coin actuated means having a normally open switch in said electrical circuit, said means responsive to movement of a released article across said uppermost telescoping member comprising normally closed electric switch means in said circuit openable when a released article moves across said uppermost telescoping member.

4. A vending machine according to claim 1, wherein said uppermost telescoping member comprises a carriage, said storage magazine having vertical track means along its sides, said carriage having vertically spaced anti-friction means riding on said track means for stabilizing said carriage against tipping, said carriage having an upper surface of similar inclination to the bottom surface of said magazine to facilitate the passage thereover of articles being discharged from said magazine and a dispensing head similarly inclined incorporating said first-named switch means.

5. A vending machine according to claim 4, wherein each of the other telescoping members comprises a horizontal bar extending across the front of the magazine and mounting anti-friction means riding on said track, said telescoping means also including a pair of vertical bars depending respectively from said carriage and from said horizontal bars, each of said vertical bars having a vertical slot and a pin connection therethrough with the adjacent vertical bar, whereby to maintain said telescoping members in connected relation with each other and permit them to telescope as said carriage is moved by said flexible element from the uppermost magazine-full position to the lowermost empty position, said magazine having upwardly open pocket elements below its inclined bottom wall vertically aligned with said telescoping vertical bars to receive the same when the vertical bars are telescoped.

6. A vending machine according to claim 2, wherein said flexible element drive shaft extends transversely of said magazine and said motor is mounted beneath said magazine with its shaft extending over and transversely of said drive shaft, said drive shaft mounting a gear and said motor shaft mounting a worm normally engaging said gear, said means for selectively disengaging said power means from said drive shaft comprising mounting means for said motor permitting said motor and said motor shaft to be swung in the horizontal plane sufficiently to disengage said worm from said gear, said drive shaft projecting outwardly from the front of said magazine, a bearing plate formed with a horizontal slot to permit the projection therethrough of said motor shaft, means resiliently biasing said motor shaft toward one end of said bearing plate slot whereby said worm is engaged with said gear, said motor shaft being selectively movable toward the other end of said slot in opposition to said resilient means to disengage said worm from said gear.

7. A vending machine according to claim 6, including a pedal below said motor shaft fulcrumed on an axis parallel to said motor shaft and having a vertically elongated slot receiving the protruding end of said motor shaft whereby upon depression of said pedal said motor shaft is shifted laterally in said slot to a position wherein said worm is disengaged from said gear.

8. A vending machine according to claim 1, wherein said wheels are sprockets and said flexible elements are chains.

9. A vending machine according to claim 1, including a display window in said cabinet, wall means defining a chamber within said cabinet in registry with said window for receiving one of the articles to be vended, said chamber having normally closed drop bottom door means over said outlet chute, and a device responsive to discharge of the last article from said storage magazine for unlatching said drop bottom door means whereby to permit said article displayed in said chamber to drop therefrom into said outlet chute.

10. A vending machine according to claim 9, wherein part of said display window chamber wall means is spaced rearwardly from and substantially parallel to said display window and bears a legend visible through said display window when the article has been discharged therefrom indicating that the machine is empty.

11. A vending machine according to claim 9 including means for selectively disengaging said power means from said flexible element drive shaft whereby to permit manual return of said telescoping members to their full height for retention of a full stock of articles in said storage magazine.

12. A vending machine according to claim 11, including an electrical circuit having a power source, said power means comprising an electric motor in said circuit, said coin actuated means having a normally open switch in said electrical circuit, said means responsive to movement of a released article across said uppermost telescoping member comprising normally closed electric switch means in said circuit openable when a released article moves across said uppermost telescoping member.

13. A vending machine according to claim 12, including a latch normally retaining said drop bottom door means in closed condition, electromagnetic means operatively connected to said latch for releasing the same when energized, said device responsive to discharge of the last article from said storage magazine comprising electrical switch means normally closing the circuit between said first-named switch means and said electric motor while articles remain in said storage magazine but resiliently biased to shunt current in said circuit from said motor to said electro magnetic means upon discharge of the last article from said magazine.

14. A vending machine according to claim 1, wherein said magazine rear wall intersects said chute substantially the same distance from the front of the magazine as the rear edge of an article folded adjacent the front of the magazine and is forwardly inclined from said bottom wall whereby to compensate for the thickness of the fold and maintain an adequate angle of slide between all articles in the magazine.

* * * * *